US012611012B2

(12) United States Patent
Riaz

(10) Patent No.: US 12,611,012 B2
(45) Date of Patent: Apr. 28, 2026

(54) MULTI-STONE JEWELRY SETTING WITH INTERNAL PIVOT MECHANISM

(71) Applicant: TARIQ RIAZ LLC, Brambleton, VA (US)

(72) Inventor: Tariq Riaz, Brambleton, VA (US)

(73) Assignee: Tariq Riaz LLC, Brambleton, VA (US)

( * ) Notice: Subject to any disclaimer, the term of this patent is extended or adjusted under 35 U.S.C. 154(b) by 0 days.

(21) Appl. No.: 19/130,419

(22) PCT Filed: May 24, 2024

(86) PCT No.: PCT/US2024/030932

§ 371 (c)(1),
(2) Date: May 15, 2025

(87) PCT Pub. No.: WO2024/243484

PCT Pub. Date: Nov. 28, 2024

(65) Prior Publication Data

US 2026/0000165 A1 Jan. 1, 2026

Related U.S. Application Data

(60) Provisional application No. 63/468,991, filed on May 25, 2023.

(51) Int. Cl.
*A44C 17/02* (2006.01)
*A44C 17/04* (2006.01)

(52) U.S. Cl.
CPC ..... *A44C 17/0266* (2013.01); *A44C 17/0275* (2013.01); *A44C 17/04* (2013.01)

(58) Field of Classification Search
CPC . A44C 15/0025; A44C 17/02; A44C 17/0258; A44C 17/0266; A44C 17/0275;
(Continued)

(56) References Cited

U.S. PATENT DOCUMENTS 922,212 A * 5/1909 Tropin ..... A44C 17/0275 63/31
3,959,989 A * 6/1976 Bhandia ..... A44C 17/0258 446/244
(Continued)

FOREIGN PATENT DOCUMENTS

CH 418033 A * 7/1966 ..... A44C 17/0258
CN 107006966 A 8/2017
(Continued)

OTHER PUBLICATIONS

International Search Report and Written Opinion mailed Aug. 22, 2024 in International Application No. PCT/US2024/030932, 13 pages.

*Primary Examiner* — Jason W San
*Assistant Examiner* — Anna S Rashid
(74) *Attorney, Agent, or Firm* — Procopio, Cory, Hargreaves & Savitch LLP

(57) ABSTRACT

A jewelry piece apparatus may include an upper housing having a first upper cradle portion, a second upper cradle portion, and a viewing window. The jewelry piece apparatus may include a lower housing having a first lower cradle portion, a second lower cradle portion, a first stopper flange, and a second stopper flange. The jewelry piece apparatus may include a pivot mechanism having a pivot shaft that supports at least two stone mounts, a first stopper tab, a second stopper tab, and a ballast chamber.

10 Claims, 14 Drawing Sheets

(58) Field of Classification Search
CPC .... A44C 17/0283; A44C 17/04; A44C 17/046
USPC ..... 63/31, 26, 28, 40
See application file for complete search history.

(56) References Cited

U.S. PATENT DOCUMENTS 4,187,697 A * 2/1980 Castelo ..... A44C 17/0275 63/15
4,270,366 A * 6/1981 Green ..... A44C 15/005 63/3
4,977,757 A * 12/1990 Mesica ..... A44C 9/00 63/29.1
5,787,731 A * 8/1998 Ebara ..... A44C 17/0266 63/15
6,318,122 B1 * 11/2001 Burgard ..... A44C 9/00 63/15
6,484,537 B2 * 11/2002 Takessian ..... A44C 17/0208 63/26
6,612,132 B2 * 9/2003 Kimura ..... A44C 17/0275 63/26
8,474,284 B2 * 7/2013 Rush ..... A63F 11/0002 63/11
10,219,593 B2 * 3/2019 Leuz ..... A44C 9/0061
11,751,647 B2 * 9/2023 Forsey ..... G04B 47/04 63/31
2007/0056321 A1 * 3/2007 Sowle ..... A44C 17/0216 63/40
2011/0179823 A1 * 7/2011 Moody ..... A44C 9/00 63/29.1
2011/0219821 A1 * 9/2011 Daniel ..... A44C 17/0258 63/26
2013/0239613 A1 * 9/2013 Shah ..... A44C 17/0275 63/27
2015/0082832 A1 * 3/2015 Mencagli ..... A44B 1/32 2/244
2016/0198817 A1 * 7/2016 Berka ..... A44C 17/0208 63/40

FOREIGN PATENT DOCUMENTS

CN 207202303 U * 4/2018
CN 107006966 B * 5/2019 ..... A44C 7/00
EP 2381811 B1 * 10/2016 ..... A44C 5/2057
JP 11266914 A * 10/1999
KR 102211510 B1 * 2/2021 ..... A44C 15/005
WO WO-02091874 A1 * 11/2002 ..... A44C 17/0258

* cited by examiner

1300

MULTI-STONE JEWELRY SETTING WITH INTERNAL PIVOT MECHANISM

BACKGROUND

Field of the Invention

The present disclosure general relates to jewelry and more particularly relates to a multi-stone jewelry setting with an internal flip mechanism.

Related Art

Conventional jewelry pieces feature static designs that become monotonous and lose their appeal over time. While conventional jewelry pieces may carry a single stone or multiple stones, when the jewelry piece is fashioned, the single stone or multiple stones are secured into a single fixed appearance. What is needed is jewelry that overcomes the significant problems found in the conventional jewelry pieces as described above.

SUMMARY

Accordingly, described herein is a jewelry setting with an internal flip mechanism that allows a single jewelry piece to have a plurality of configurations. The presently described jewelry setting provides a dynamic stone and color changing capability that presents a surprising and variable visual experience and allows the wearer to showcase personal style and creativity.

In some aspects, the techniques described herein relate to a jewelry piece including: an upper housing having a first upper cradle portion, a second upper cradle portion, and a viewing window; a lower housing having a first lower cradle portion, a second lower cradle portion, a first stopper flange, and a second stopper flange; a pivot mechanism having a pivot shaft that supports at least two stone mounts, a first stopper tab, a second stopper tab, and a ballast chamber.

In some aspects, the techniques described herein relate to a jewelry piece, wherein the first upper cradle portion and the first lower cradle portion secure a first end of the pivot shaft when the upper housing is joined to the lower housing.

In some aspects, the techniques described herein relate to a jewelry piece, wherein the second upper cradle portion and the second lower cradle portion secure a second end of the pivot shaft when the upper housing is joined to the lower housing.

In some aspects, the techniques described herein relate to a jewelry piece, wherein the first stopper tab is configured to engage the first stopper flange when the second stone mount is positioned below the viewing window of the upper housing.

In some aspects, the techniques described herein relate to a jewelry piece, wherein the second stopper tab is configured to engage the second stopper flange when the first stone mount is positioned below the viewing window of the upper housing.

In some aspects, the techniques described herein relate to a jewelry piece, wherein the pivot mechanism is configured to pivot along a pivot axis of the pivot shaft to alternately position the first stone mount and the second stone mount below the viewing window of the upper housing.

In some aspects, the techniques described herein relate to a jewelry piece, wherein the ballast chamber is configured to secure an amount of ballast material to balance the pivot mechanism when the upper housing is joined to the lower housing.

In some aspects, the techniques described herein relate to a jewelry piece, wherein a perimeter wall of the ballast chamber is the first stopper tab.

In some aspects, the techniques described herein relate to a jewelry piece, wherein the amount of ballast in the ballast chamber provides a bias configured to position the first stone mount below the viewing window more frequently than the second stone mount.

In some aspects, the techniques described herein relate to a method for crafting a jewelry piece having an upper housing with a viewing window and a lower housing, the method including: securing a first stone in a first stone mount, the first stone mount supported by a pivot shaft of a pivot mechanism; securing a second stone in a second stone mount, the second stone mount supported by the pivot shaft of the pivot mechanism and offset from the first stone mount; positioning a first end of the pivot shaft in a first lower cradle attached to the lower housing; positioning a second end of the pivot shaft in a second lower cradle attached to the lower housing; adjusting an amount of ballast material in a ballast chamber of the pivot mechanism to balance the pivot mechanism in the first and second lower cradles; affixing the upper housing to the lower housing to secure the first end of the pivot shaft between a first upper cradle and the first lower cradle and to secure the second end of the pivot shaft between a second upper cradle and the second lower cradle.

Other features and advantages of the present invention will become more readily apparent to those of ordinary skill in the art after reviewing the following detailed description and accompanying drawings.

BRIEF DESCRIPTION OF THE DRAWINGS

The structure and operation of the present invention will be understood from a review of the following detailed description and the accompanying drawings in which like reference numerals refer to like parts and in which.

DETAILED DESCRIPTION

Disclosed herein is a multi-stone jewelry piece apparatus and a method of making a multi-stone jewelry piece. For example, one method disclosed herein allows for a pivot mechanism supporting at least two stones to be appropriately balanced in a cradle defined by an upper housing and a lower housing. An amount of ballast is employed to balance the pivot mechanism along a pivot axis of a pivot shaft such that one of the at least two stones is always positioned below a viewing window of the upper housing.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

Figure 1:
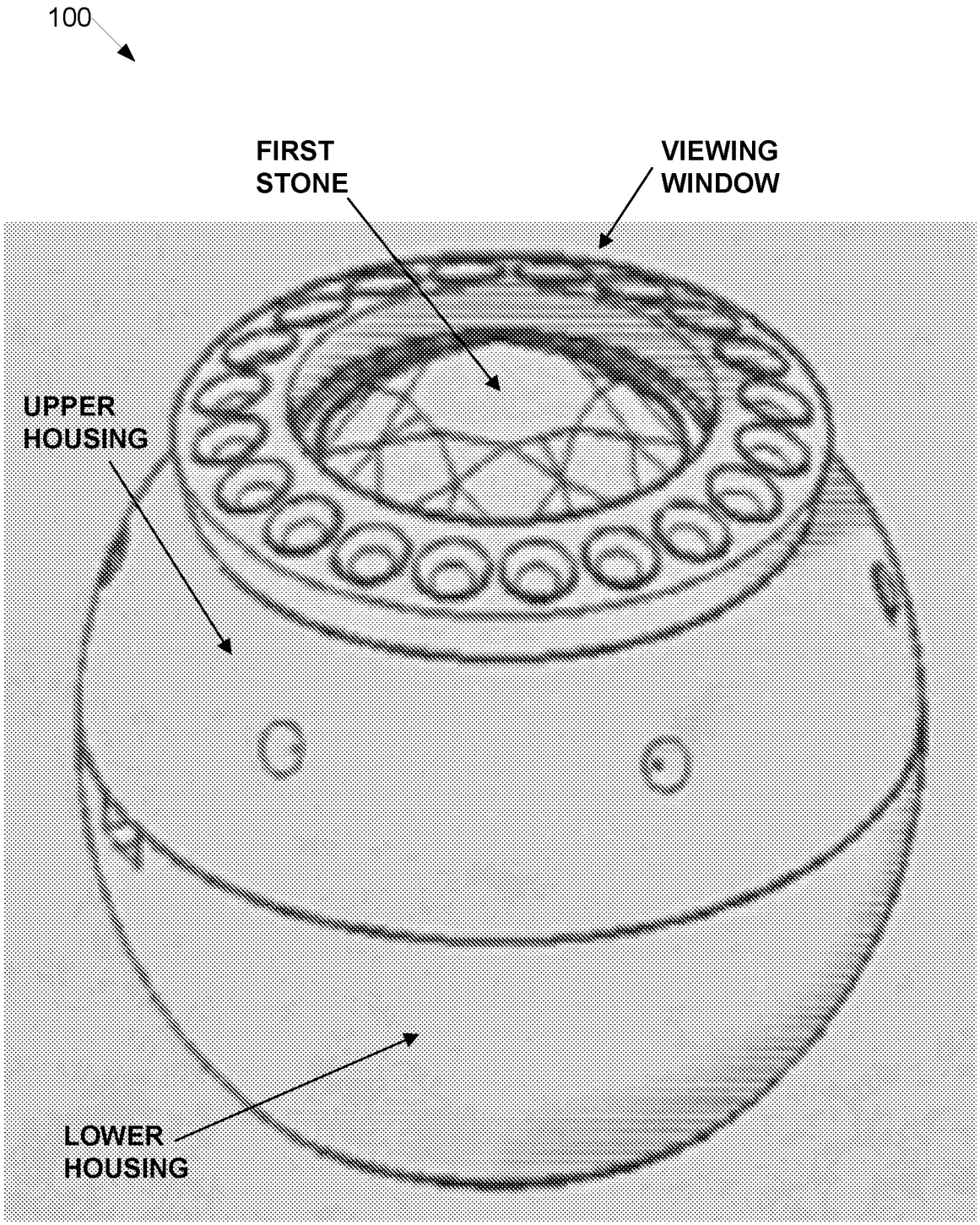
FIG. 1 illustrates an example multi-stone jewelry piece in a first orientation, according to an embodiment.

FIG. 1 illustrates an example multi-stone jewelry piece 100 in a first orientation, according to an embodiment. In the illustrated embodiment, a first stone is positioned below a viewing window where it can be seen. The viewing window is cut out of an upper housing and the upper housing is affixed to a lower housing to form the jewelry piece 100.

Figure 2:
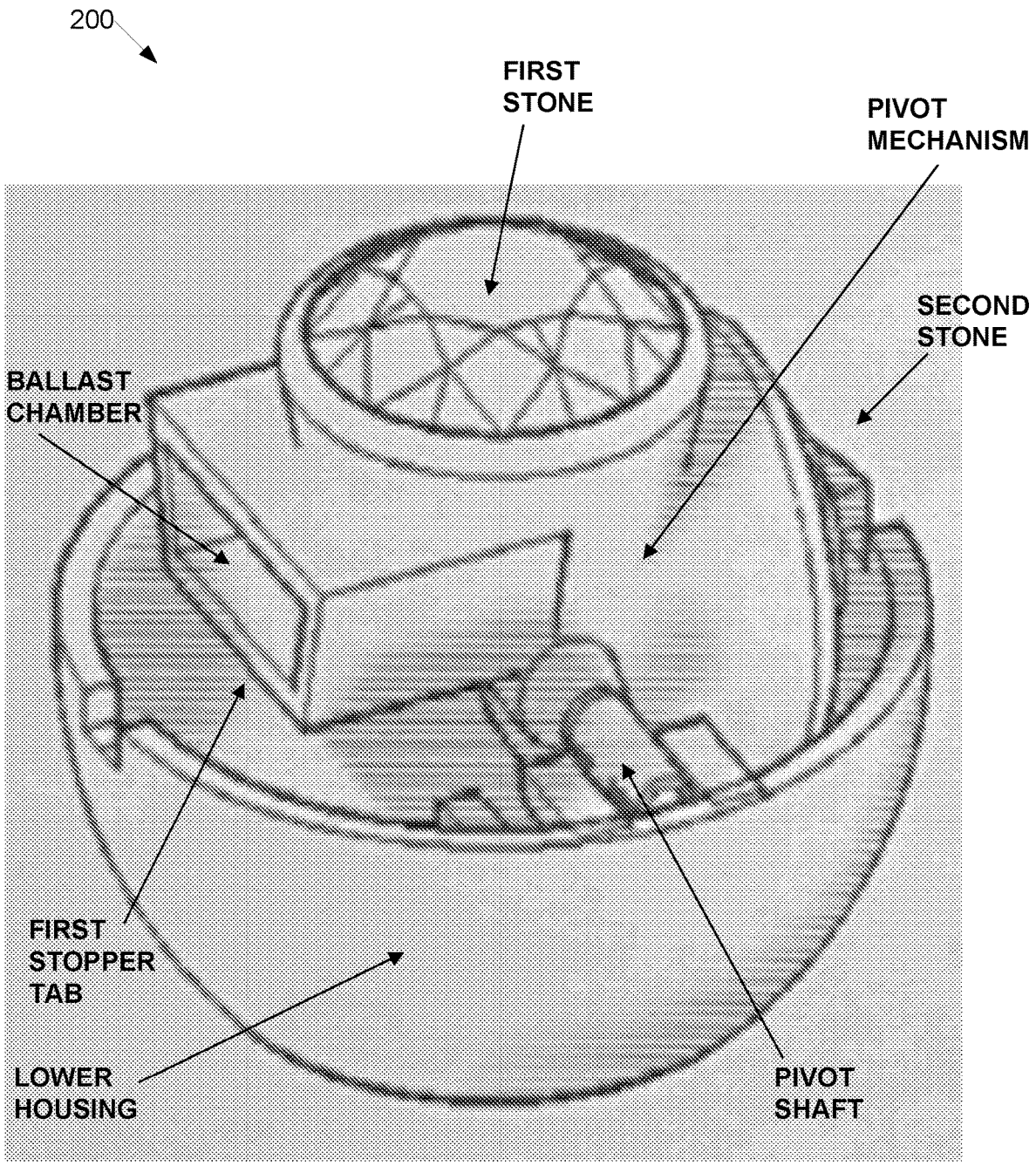
FIG. 2 illustrates an example multi-stone jewelry piece in a first orientation with an upper housing portion removed, according to an embodiment.

FIG. 2 illustrates an example multi-stone jewelry piece 200 in a first orientation with an upper housing portion removed, according to an embodiment. With the upper housing portion removed, the pivot mechanism is visible. The pivot mechanism includes a plurality of stone mounts. For example, a first stone mount and a second stone mount as shown in the illustrated embodiment. Additional stone mounts may also be included. The stone mounts are supported by a pivot shaft of the pivot mechanism. The pivot mechanism also includes a ballast chamber. One wall of the ballast chamber operates as a first stopper tab. The ballast chamber is configured to receive an amount of ballast material, for example, gold or some other metal, to balance the pivot mechanism along the pivot axis of the pivot shaft so that the plurality of stones are alternatively positioned in the viewing window of the upper housing.

Figure 3:
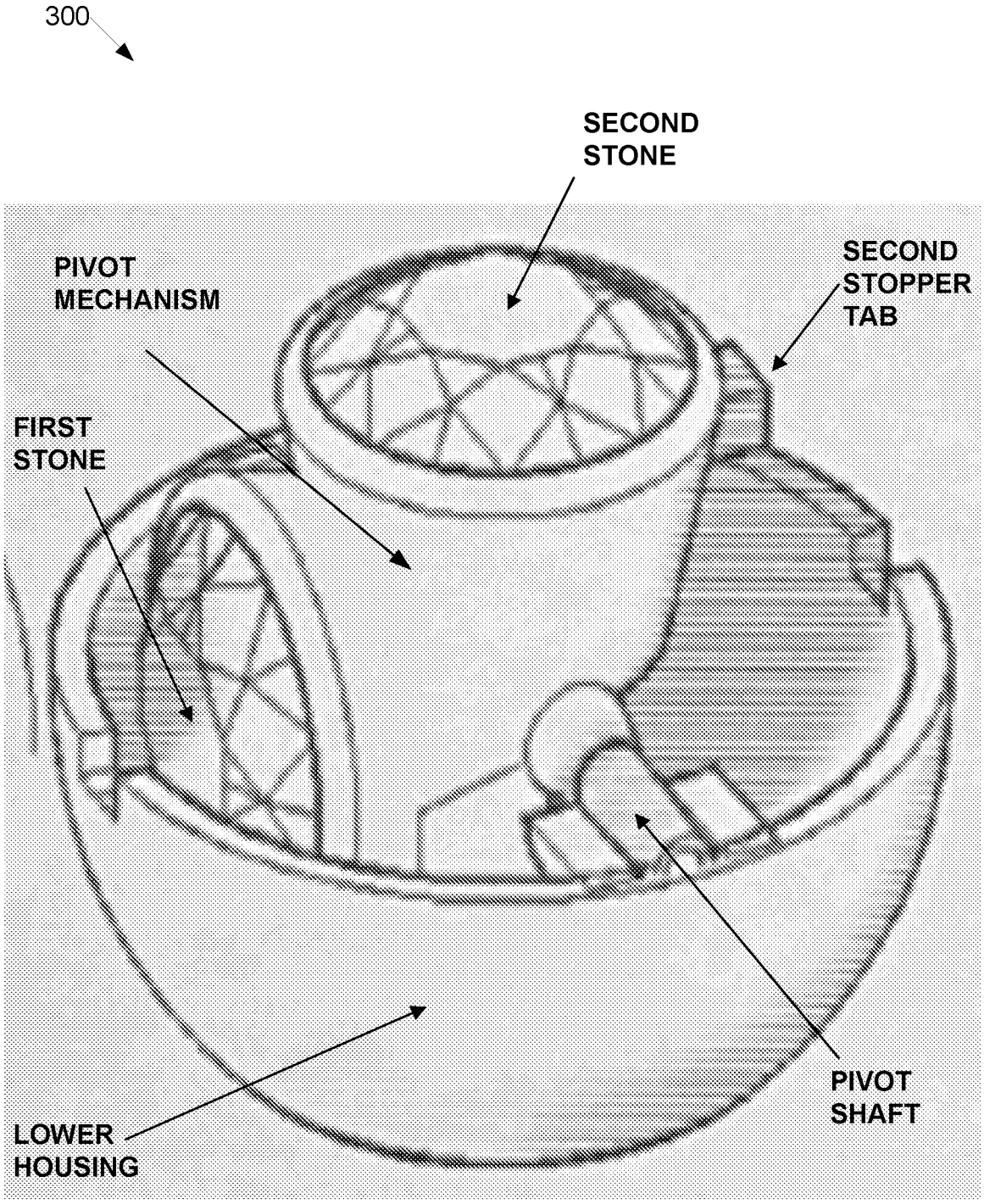
FIG. 3 illustrates an example multi-stone jewelry piece in a second orientation with an upper portion removed, according to an embodiment.

FIG. 3 illustrates an example multi-stone jewelry piece 300 in a second orientation with an upper portion removed, according to an embodiment. In the illustrated embodiment, the pivot mechanism is in a second position such that the second stone is positioned in the viewing window of the upper housing.

Figure 4:
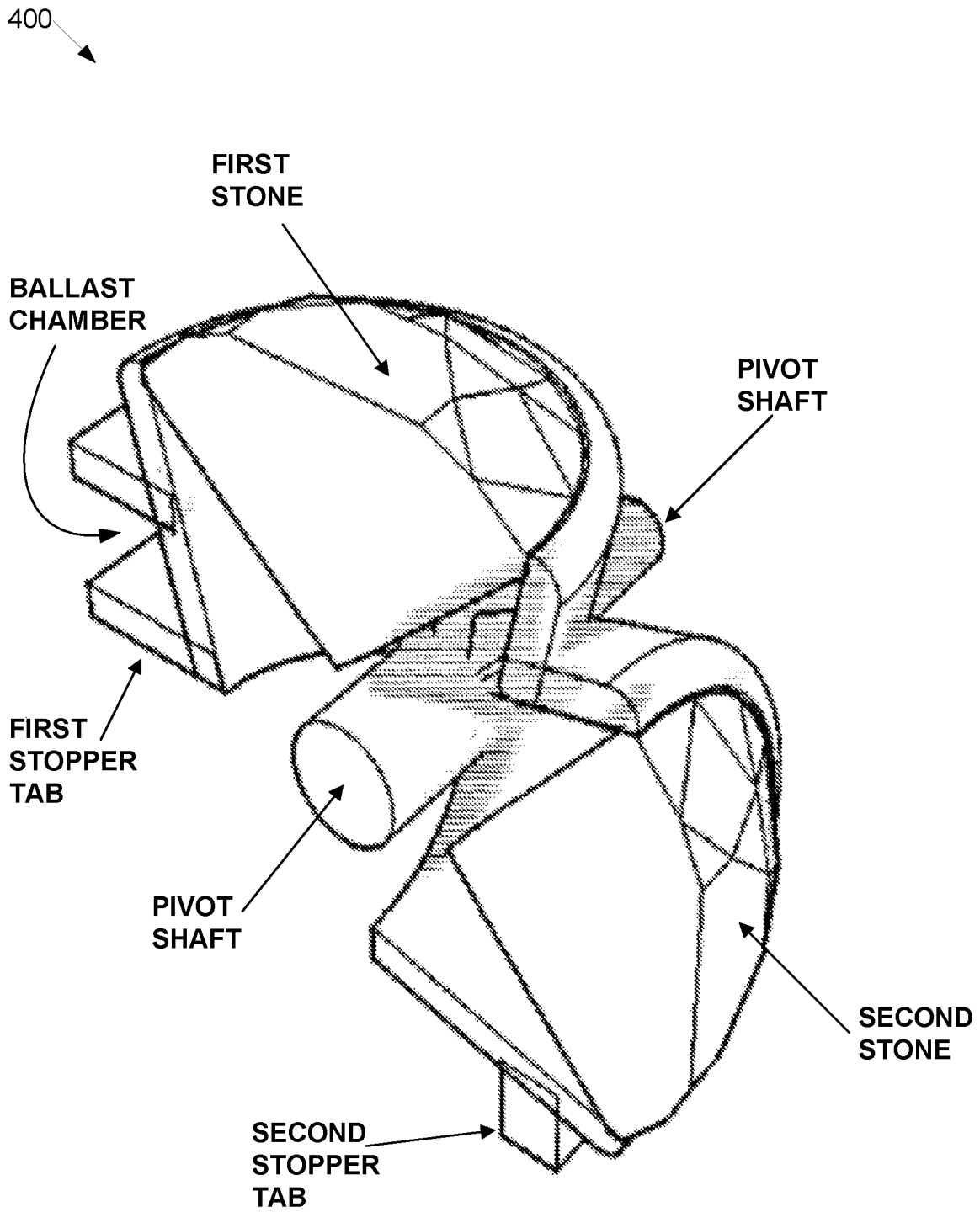
FIG. 4 illustrates an example pivot mechanism, according to an embodiment.

FIG. 4 illustrates an example pivot mechanism 400, according to an embodiment. In the illustrated embodiment, the first stopper tab is shown as one of the walls of the ballast chamber. Additionally, the illustrated embodiment shows the second stopper tab portion of the pivot mechanism. The second stopper tab is shown extending from a portion of the pivot mechanism that supports the second stone and opposing the ballast chamber across the pivot axis of the pivot shaft. In alternative embodiments, the second stopper tab may be configured as a second ballast chamber to allow for the use of first and second stones having different weights and balancing the first and second stones along the pivot axis of the pivot shaft.

Figure 5:
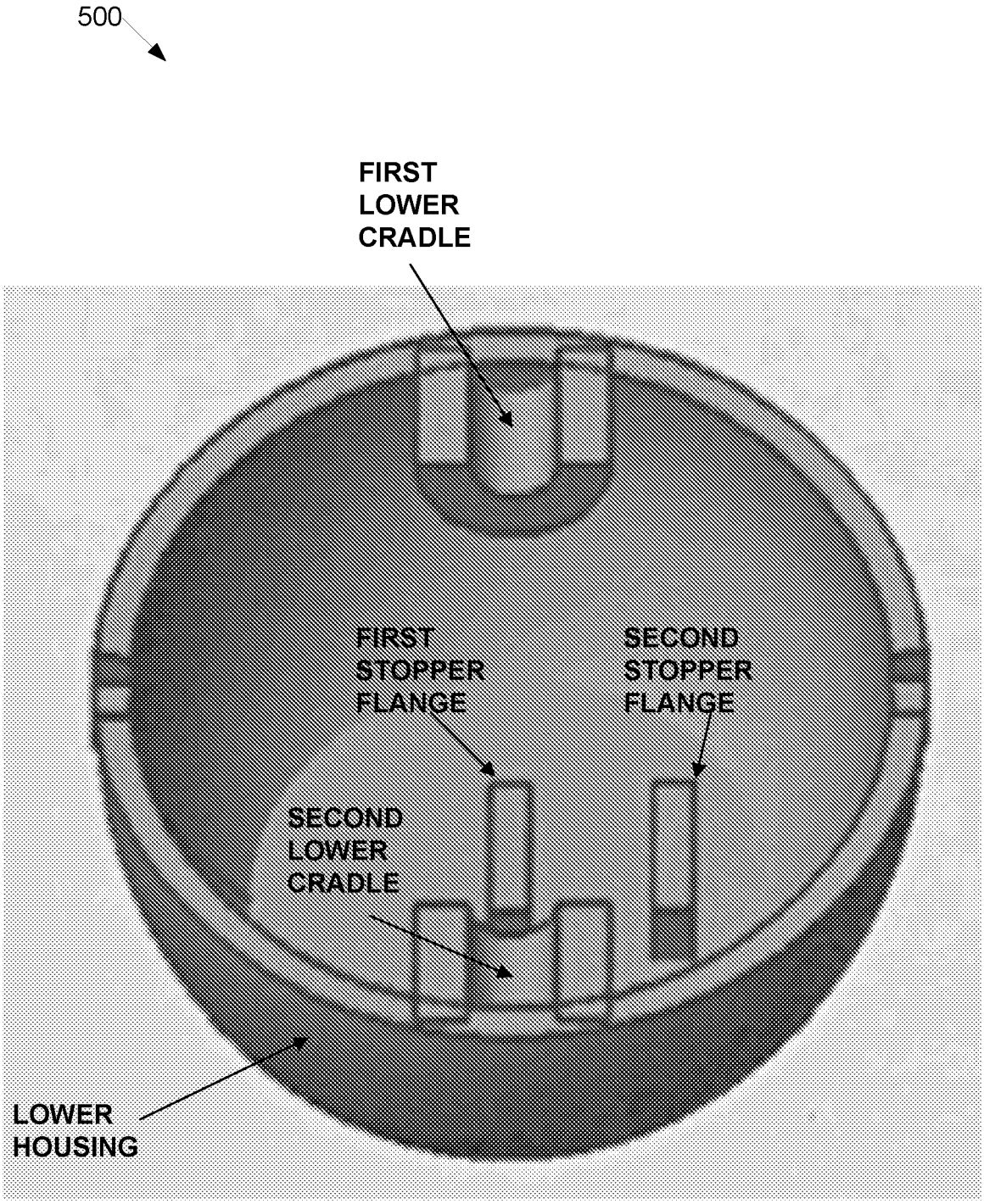
FIG. 5 illustrates an example lower housing portion of a multi-stone jewelry piece, according to an embodiment.

FIG. 5 illustrates an example lower housing portion 500 of a multi-stone jewelry piece, according to an embodiment. In the illustrated embodiment, the lower housing portion includes first and second stopper flanges that are positioned to engage the first and second topper tabs when the pivot mechanism is in the first or second position. Advantageously, when the pivot mechanism rotates along the pivot axis of the pivot shaft, the first or second stopper flanges prevent rotation of the pivot mechanism to a point where no stone is positioned in the viewing window of the upper housing and to prevent rotation of the pivot mechanism to a point only apportion of a stone is positioned in the viewing window of the upper housing.

The lower housing portion 500 also includes a first lower cradle configured to support a first end of the pivot shaft. The lower housing portion 500 also includes a second lower cradle configured to support a second end of the pivot shaft. In one aspect, the pivot shaft cradle secures the pivot shaft between the upper housing and the lower housing and positions the pivot mechanism between the upper housing and the lower housing such that the pivot mechanism can rotate about the pivot axis of the pivot shaft. In alternative aspects, a portion of the upper housing or lower housing (or both) may provide a recess or protrusion that receives an end of the pivot shaft to maintain a desired position of the pivot shaft when the pivot shaft is secured in the pivot shaft cradle. The first lower cradle and the second lower cradle are configured to align with a first upper cradle and a second upper cradle to secure the pivot shaft in position when the upper housing is affixed to the lower housing.

Figure 6:
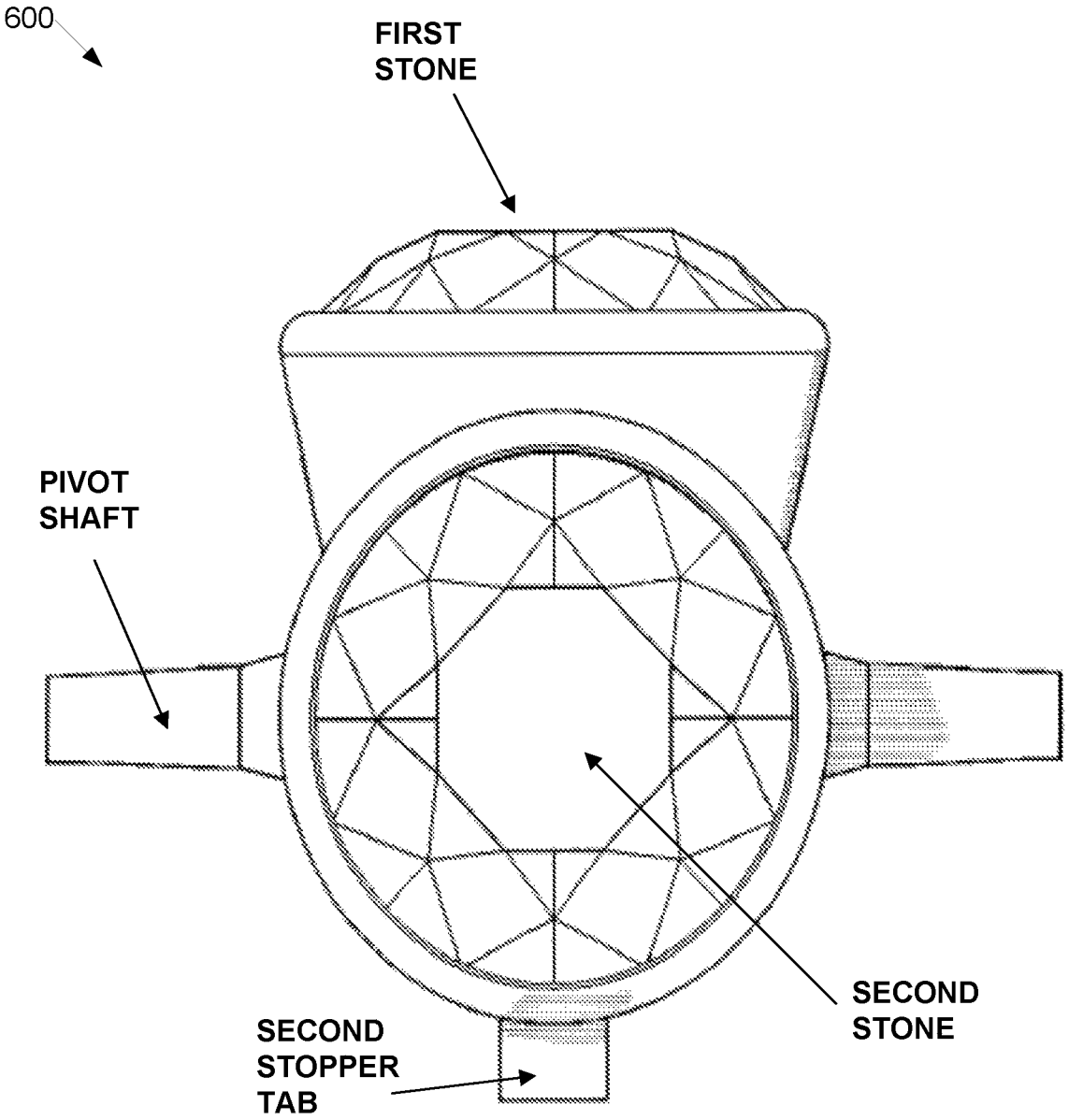
FIG. 6 illustrates an example pivot mechanism in a first orientation, according to an embodiment.

FIG. 6 illustrates an example pivot mechanism 600 in a first orientation, according to an embodiment. In the illustrated embodiment, the first stone is positioned in the viewing window (not shown) of the upper housing (not shown) and the second stopper tab is engaged with the second stopper flange (not shown).

Figure 7:
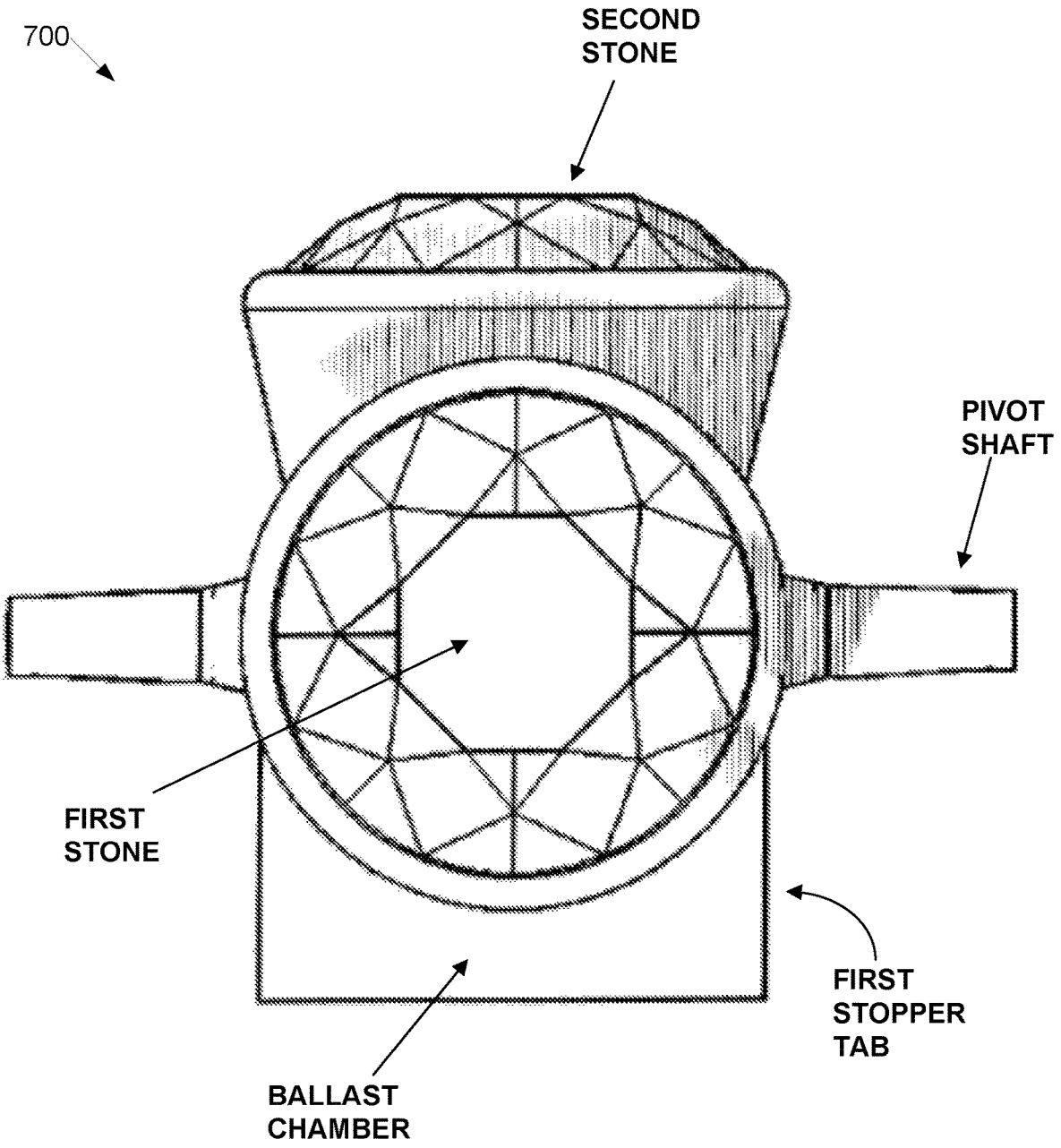
FIG. 7 illustrates an example pivot mechanism in a second orientation, according to an embodiment.

FIG. 7 illustrates an example pivot mechanism 700 in a second orientation, according to an embodiment. In the illustrated embodiment, the second stone is positioned in the viewing window (not shown) of the upper housing (not shown) and the first stopper tab, which is the back wall of the ballast chamber, is engaged with the first stopper flange (not shown).

Figure 8:
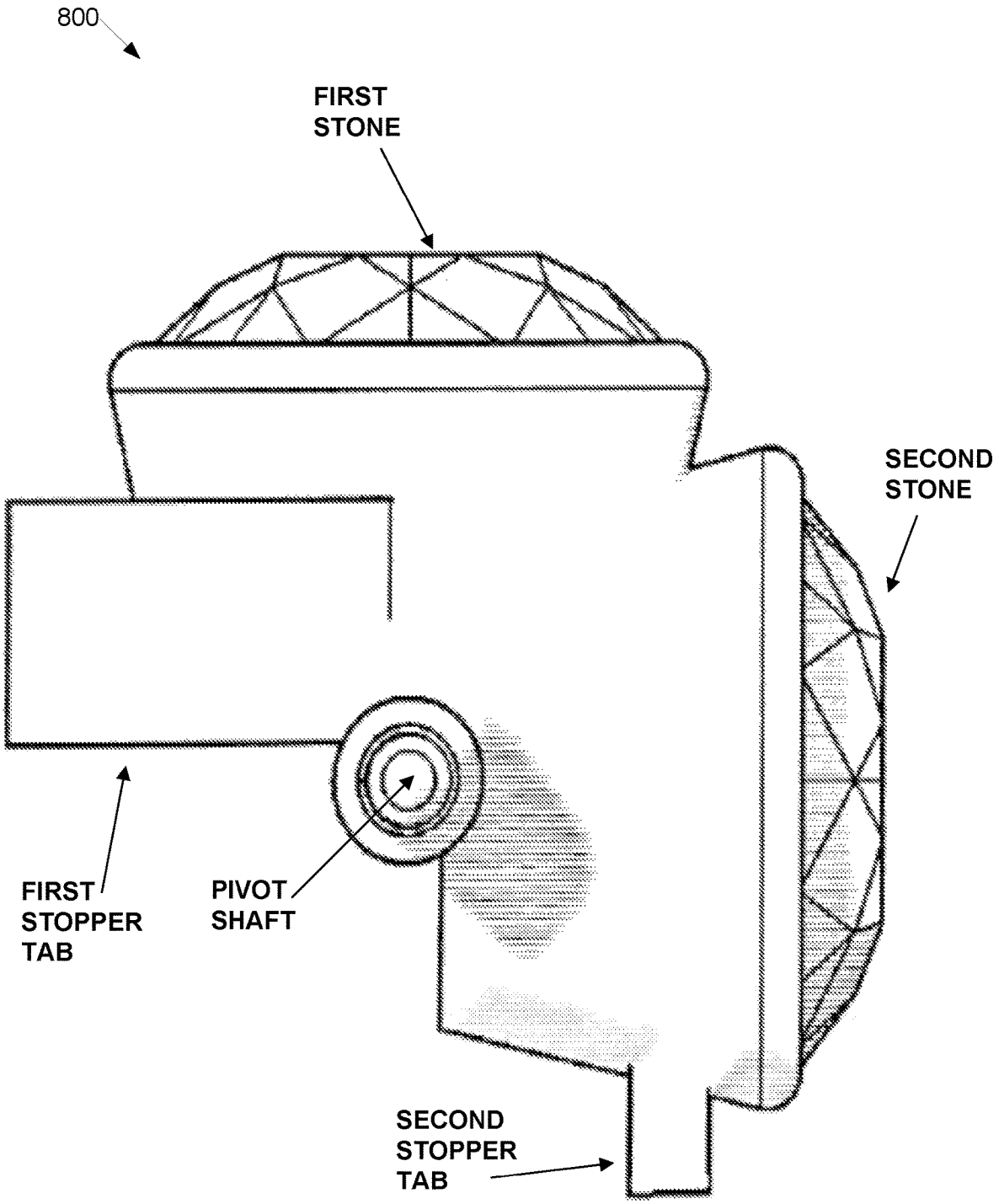
FIG. 8 illustrates an example side view of a pivot mechanism in a first orientation, according to an embodiment.

FIG. 8 illustrates an example side view of a pivot mechanism 800 in a first orientation, according to an embodiment. In the illustrated embodiment, the first stone is positioned in the viewing window of the upper housing (not shown) and the second stopper tab is engaged with the second stopper flange. Although only two stones are illustrated in this embodiment, three or more stones could be supported by the pivot mechanism and rotated into position in the viewing window of the upper housing as the pivot mechanism rotates around the pivot axis of the pivot shaft.

Figure 9:
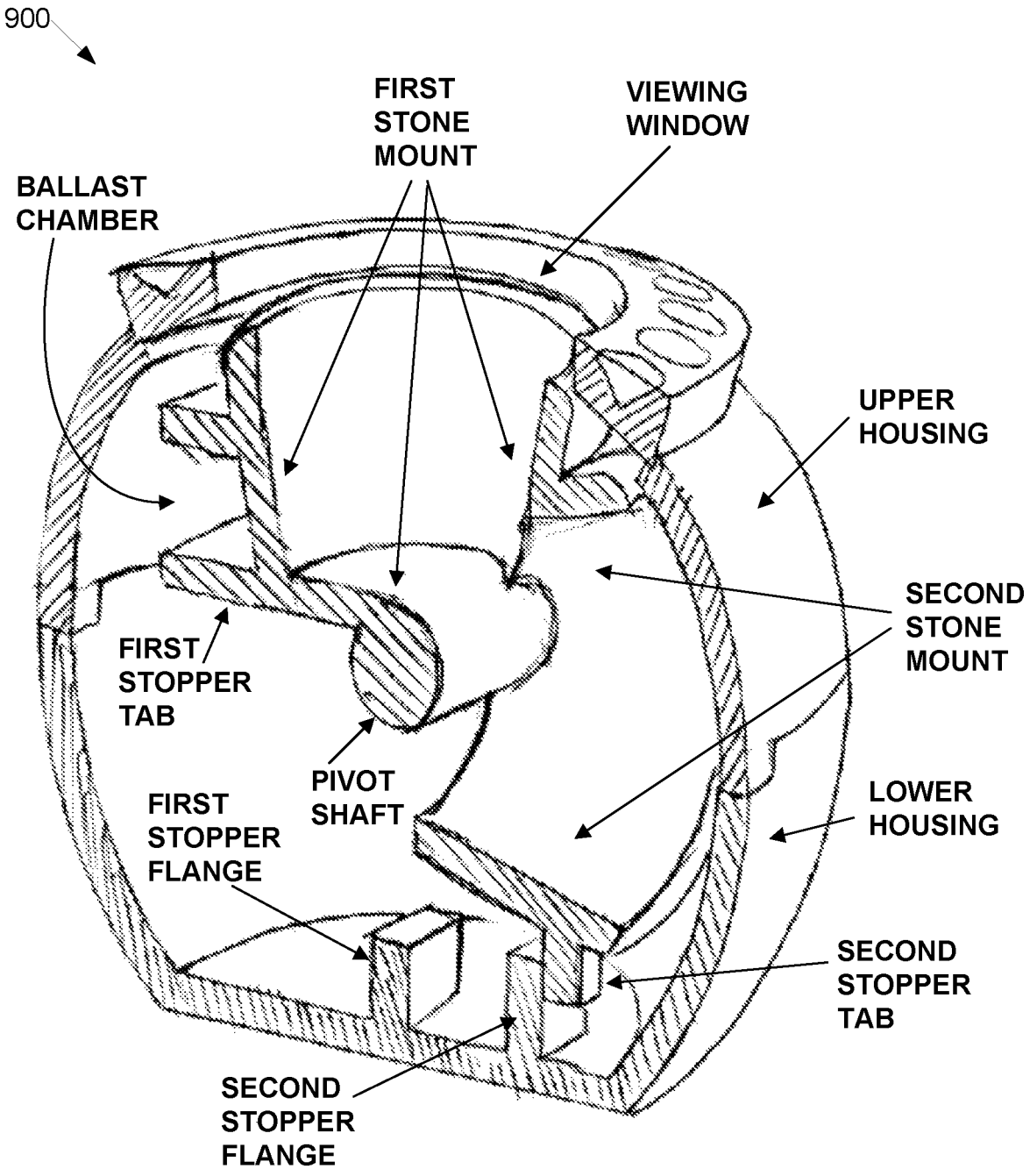
FIG. 9 illustrates an example cross section of a multi-stone jewelry piece in a first orientation, according to an embodiment.

FIG. 9 illustrates an example cross section of a multi-stone jewelry piece 900 in a first orientation, according to an embodiment. In the illustrated embodiment, the pivot mechanism is positioned such that the first stone (not shown), which is secured in the first stone mount, is positioned in the viewing window of the upper housing. The second stone (not shown), which is secured in the second stone mount, is positioned within the chamber defined by the upper and lower housing and is not visible. The second stopper tab is engaged with the second stopper flange and the weight of the second stone offsets the weight of the first stone and the amount of ballast in the ballast chamber to balance the pivot mechanism along the pivot axis of the pivot shaft so that the first stone remains in the viewing window of the upper housing.

Figure 10:
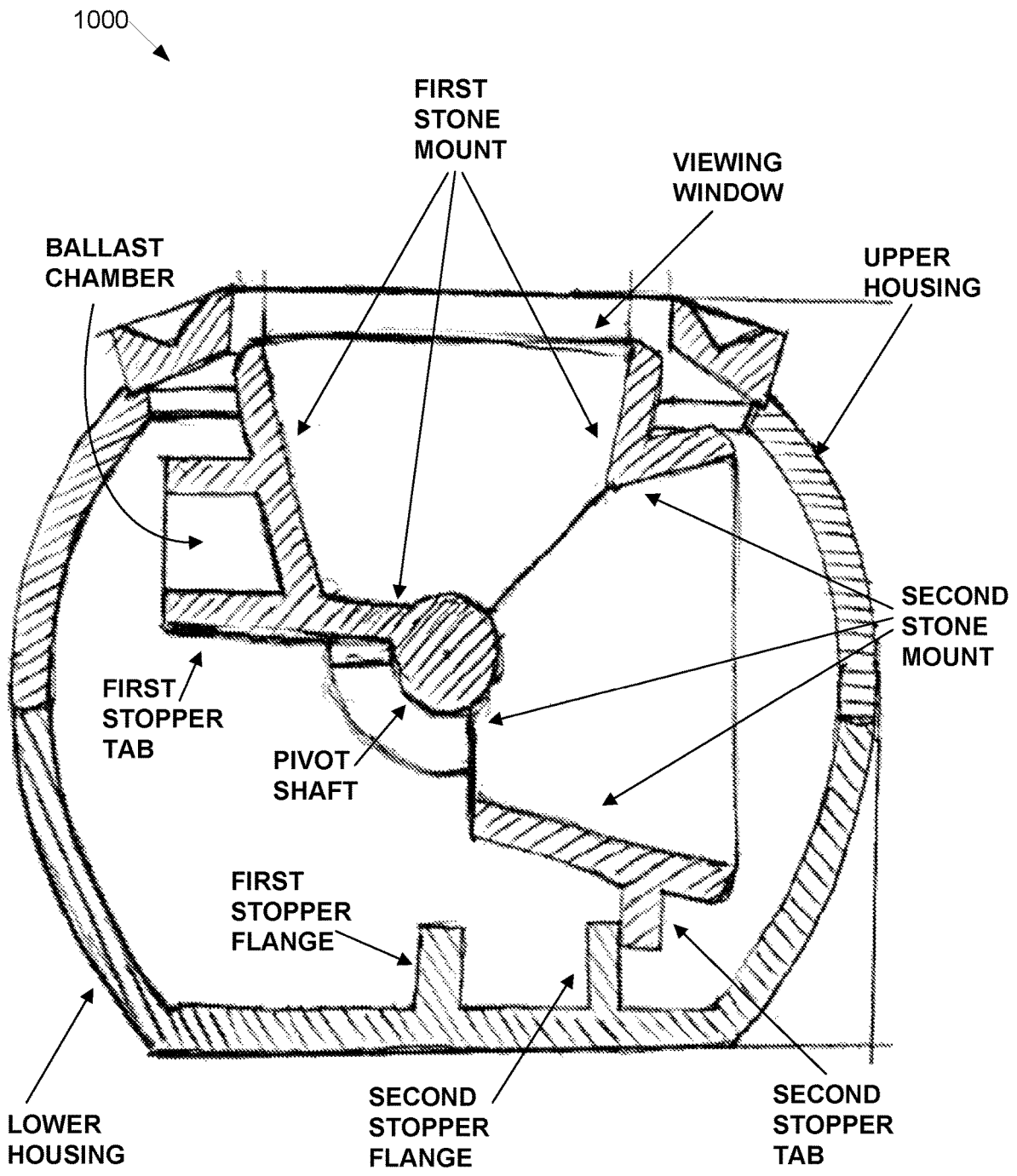
FIG. 10 illustrates an example cross section of a multi-stone jewelry piece in a first orientation, according to an embodiment.

FIG. 10 illustrates an example cross section of a multi-stone jewelry piece 1000 in a first orientation, according to an embodiment. FIG. 10 shows the same first orientation as FIG. 9, but from a direct cross section view while FIG. 9 provides a perspective cross section view.

Figure 11:
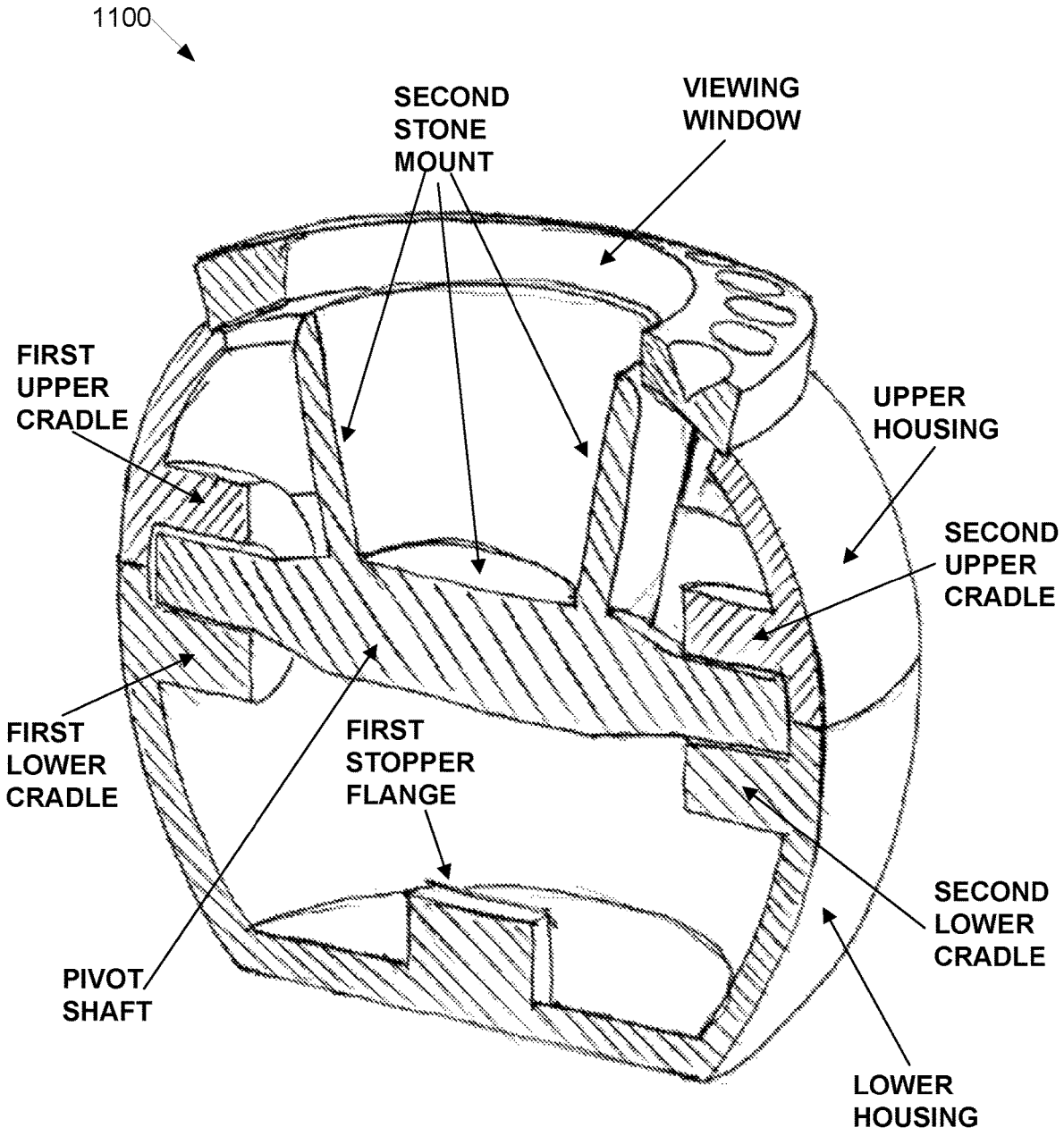
FIG. 11 illustrates an example cross section of a multi-stone jewelry piece in a second orientation, according to an embodiment.

FIG. 11 illustrates an example cross section of a multi-stone jewelry piece 1100 in a second orientation, according to an embodiment. In the illustrated embodiment, the pivot mechanism is positioned such that the second stone (not shown), which is secured in the second stone mount, is positioned in the viewing window of the upper housing. The first stone (not shown), which is secured in the first stone mount, is positioned within the chamber defined by the upper and lower housing and is not visible. The first stopper tab (not shown) is engaged with the first stopper flange and the weight of the first stone and any ballast material in the ballast chamber offsets the weight of the second stone to balance the pivot mechanism along the pivot axis of the pivot shaft so that the second stone remains in the viewing window of the upper housing.

Figure 12:
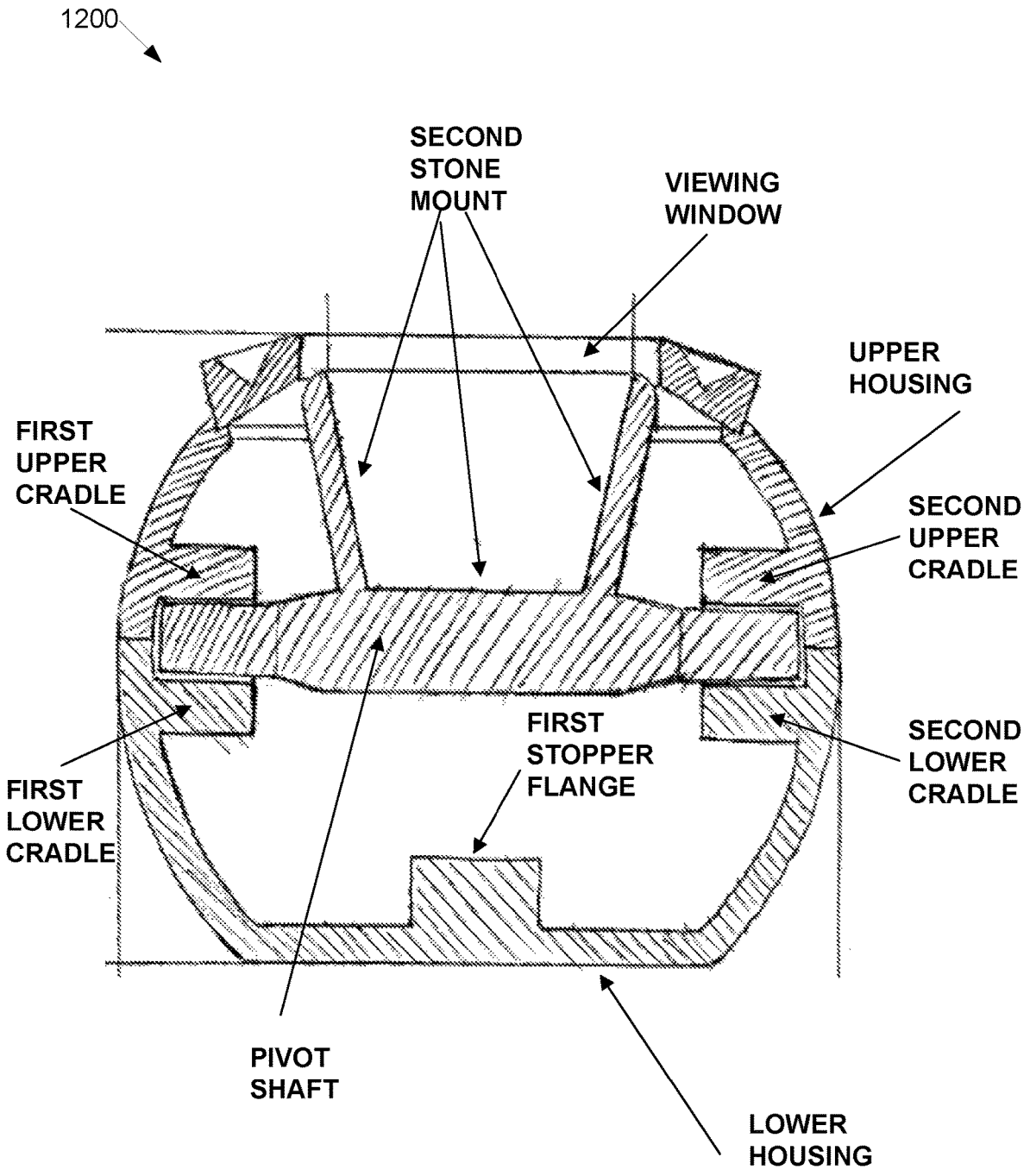
FIG. 12 illustrates an example cross section of a multi-stone jewelry piece in a second orientation, according to an embodiment.

FIG. 12 illustrates an example cross section of a multi-stone jewelry piece 1200 in a second orientation, according to an embodiment. FIG. 12 shows the same second orientation as FIG. 11, but from a direct cross section view while FIG. 11 provides a perspective cross section view.

Figure 13:
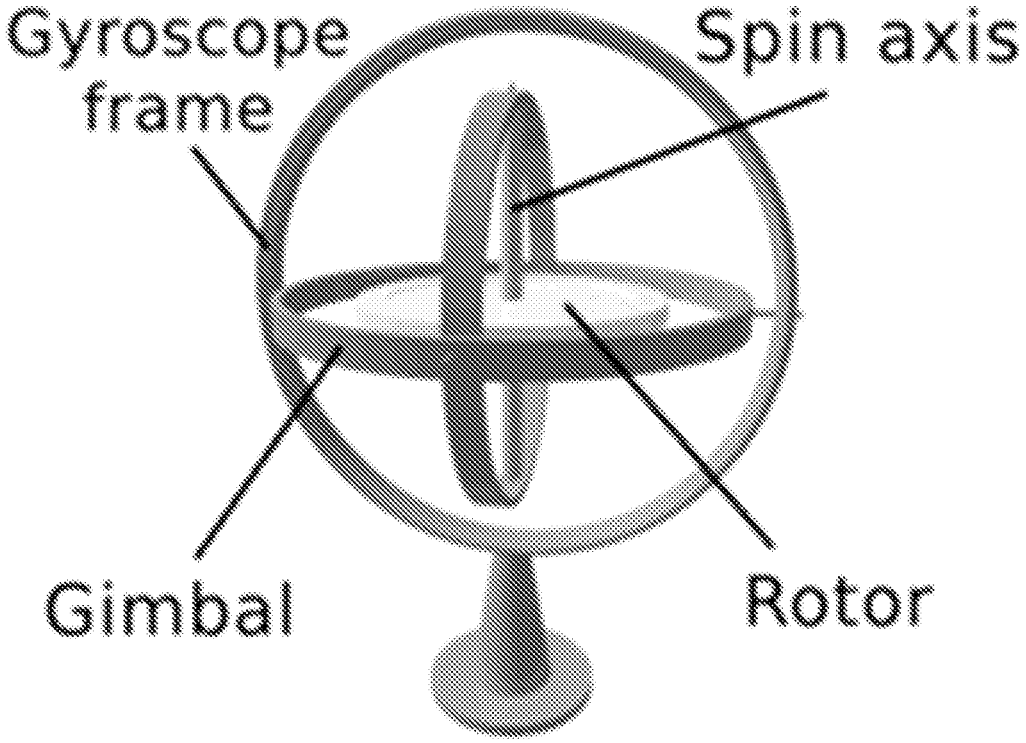
FIG. 13 illustrates an example gimbal mechanism according to an embodiment.

FIG. 13 illustrates an example gimbal mechanism 1300 according to an embodiment. In an aspect, the gimbal mechanism may replace the pivot shaft that has a single pivot axis. Advantageously the gimble mechanism has plural axes of rotation to allow for a plurality of stones to be alternatively positioned in one or more viewing windows of a housing of a jewelry piece.

Figure 14:
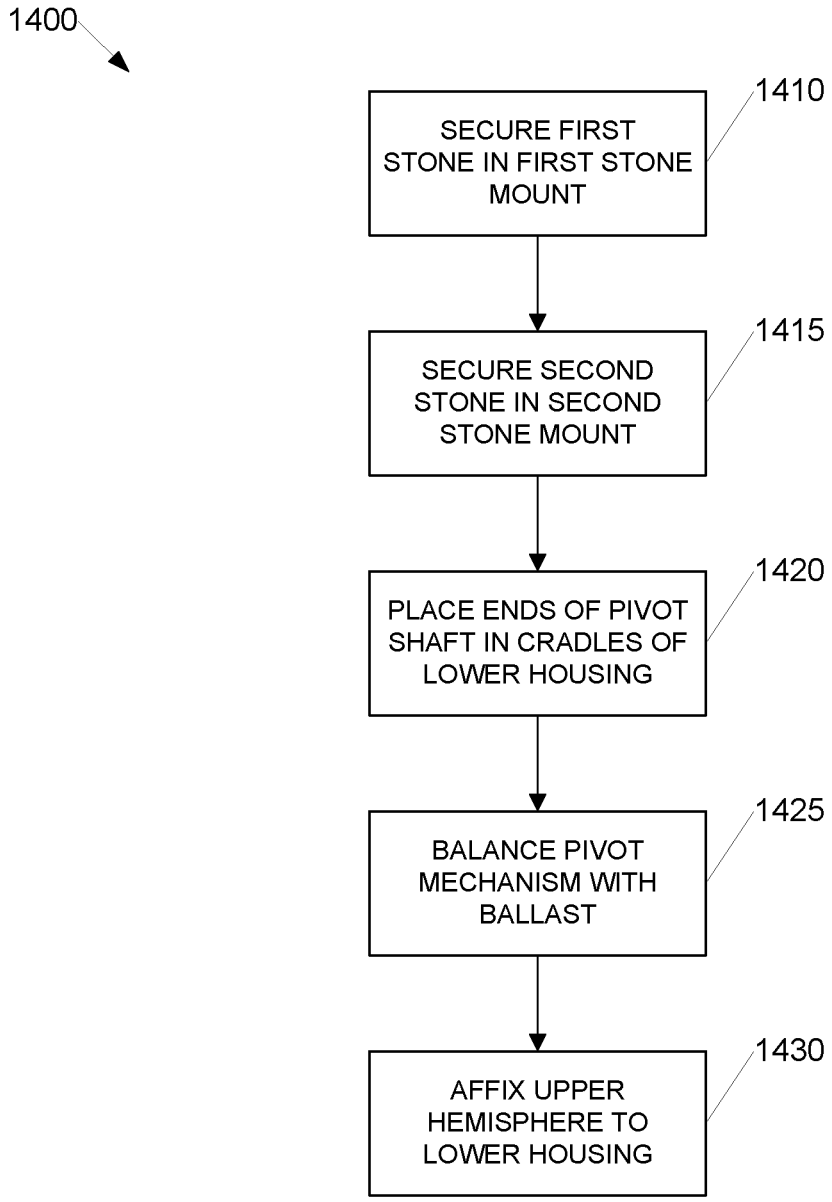
FIG. 14 is a flow diagram illustrating an example process for manufacturing a jewelry setting with an internal pivot mechanism according to an embodiment of the invention.

FIG. 14 is a flow diagram illustrating an example process 1400 for manufacturing a jewelry setting with an internal pivot mechanism according to an embodiment of the invention. Initially, at 1410, a first stone is secured in a first stone mount, the first stone mount supported by a pivot shaft of a pivot mechanism.

Next, at 1415, a second stone is secured in a second stone mount, the second stone mount supported by the pivot shaft of the pivot mechanism and offset from the first stone mount.

Next, at 1420, a first end of the pivot shaft is positioned in a first lower cradle attached to the lower housing. Additionally, a second end of the pivot shaft is positioned in a second lower cradle attached to the lower housing.

Next, at 1425, an amount of ballast material in a ballast chamber of the pivot mechanism is adjusted to balance the pivot mechanism in the first and second lower cradles. In one aspect, the ballast material may be gold or some other light metal or heavy metal that is welded into the ballast chamber. Advantageously the weight of the combination of the ballast and the first stone counterbalance the weight of the second stone across the pivot axis. In one aspect, the counterbalance can be biased to show the first stone more often than the second stone or alternatively biased to show the second stone more often than the first stone. This bias may be accomplished by increasing or decreasing the amount of the ballast material.

Next, at 1430, the upper housing is affixed to the lower housing to secure the first end of the pivot shaft between a first upper cradle and the first lower cradle and to secure the second end of the pivot shaft between a second upper cradle and the second lower cradle.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly not limited.

What is claimed is:

1. A jewelry piece comprising:

an upper housing having a first upper cradle portion, a second upper cradle portion, and a viewing window;

a lower housing having a first lower cradle portion, a second lower cradle portion, a first stopper flange, and a second stopper flange;

a pivot mechanism having a pivot shaft that supports at least two stone mounts, a first stopper tab, a second stopper tab, and a ballast chamber.

2. The jewelry piece of claim 1, wherein the first upper cradle portion and the first lower cradle portion secure a first end of the pivot shaft when the upper housing is joined to the lower housing.

3. The jewelry piece of claim 1, wherein the second upper cradle portion and the second lower cradle portion secure a second end of the pivot shaft when the upper housing is joined to the lower housing.

4. The jewelry piece of claim 1, wherein the first stopper tab is configured to engage the first stopper flange when the second stone mount is positioned below the viewing window of the upper housing.

5. The jewelry piece of claim 1, wherein the second stopper tab is configured to engage the second stopper flange when the first stone mount is positioned below the viewing window of the upper housing.

6. The jewelry piece of claim 1, wherein the pivot mechanism is configured to pivot along a pivot axis of the pivot shaft to alternately position the first stone mount and the second stone mount below the viewing window of the upper housing.

7. The jewelry piece of claim 1, wherein the ballast chamber is configured to secure an amount of ballast material to balance the pivot mechanism when the upper housing is joined to the lower housing.

8. The jewelry piece of claim 7, wherein a perimeter wall of the ballast chamber is the first stopper tab.

9. The jewelry piece of claim 7, wherein the amount of ballast in the ballast chamber provides a bias configured to position the first stone mount below the viewing window more frequently than the second stone mount.

10. A method for crafting a jewelry piece having an upper housing with a viewing window and a lower housing, the method comprising:

securing a first stone in a first stone mount, the first stone mount supported by a pivot shaft of a pivot mechanism;

securing a second stone in a second stone mount, the second stone mount supported by the pivot shaft of the pivot mechanism and offset from the first stone mount;

positioning a first end of the pivot shaft in a first lower cradle attached to the lower housing;

positioning a second end of the pivot shaft in a second lower cradle attached to the lower housing;

adjusting an amount of ballast material in a ballast chamber of the pivot mechanism to balance the pivot mechanism in the first and second lower cradles;

affixing the upper housing to the lower housing to secure the first end of the pivot shaft between a first upper cradle and the first lower cradle and to secure the second end of the pivot shaft between a second upper cradle and the second lower cradle.

* * * * *